US009924819B2

(12) United States Patent
Talberg

(10) Patent No.: US 9,924,819 B2
(45) Date of Patent: Mar. 27, 2018

(54) BRACELET ATTACHING AID

(71) Applicant: James R. Talberg, Centerville, MN (US)

(72) Inventor: James R. Talberg, Centerville, MN (US)

(73) Assignee: James R. Talberg, Centerville, MN (US)

( * ) Notice: Subject to any disclaimer, the term of this patent is extended or adjusted under 35 U.S.C. 154(b) by 25 days.

(21) Appl. No.: 15/205,834

(22) Filed: Jul. 8, 2016

(65) Prior Publication Data

US 2017/0303720 A1 Oct. 26, 2017

Related U.S. Application Data

(60) Provisional application No. 62/325,522, filed on Apr. 21, 2016.

(51) Int. Cl.
*A47G 25/90* (2006.01)

(52) U.S. Cl.
CPC ..... *A47G 25/901* (2013.01); *A47G 25/90* (2013.01)

(58) Field of Classification Search
CPC ..... A47G 25/80; A47G 25/90; A47G 25/901; B25B 27/00
USPC ..... D2/641; D11/86
See application file for complete search history.

(56) References Cited

U.S. PATENT DOCUMENTS 1,222,510 A * 4/1917 Zirkle ..... D06F 55/00 211/119.13
2,896,890 A 7/1959 Hlavac
2,926,875 A 3/1960 Hoye
2,981,507 A 4/1961 Dawson
3,016,589 A 1/1962 Collins
3,130,462 A 4/1964 Mitchell
3,242,540 A 3/1966 Mitchell
4,650,141 A 3/1987 Longo et al.
4,734,973 A 4/1988 Longo et al.
4,777,949 A * 10/1988 Perlin ..... A61B 17/1227 24/546
4,779,312 A 10/1988 Carlson
D323,132 S 1/1992 Grennan
D348,187 S 6/1994 Higgins
5,405,066 A 4/1995 Fakier
D363,042 S 10/1995 Papernik et al.
(Continued)

*Primary Examiner* — Ismael Izaguirre
(74) *Attorney, Agent, or Firm* — Fogg & Powers LLC

(57) ABSTRACT

A bracelet attaching aid is provided. The bracelet attaching aid includes a main base member, a biasing portion, and a manipulation portion. The main base member includes a first elongated portion terminating in a first holding end portion and a second elongated portion terminating in a second holding end portion. The first holding end portion and the second holding end portion are configured and arranged to selectively hold a connection portion of a bracelet there between. The biasing portion is coupled to bias the second holding end portion of the second elongated portion away from the first holding end portion of the first elongated member. The manipulation portion is coupled to the second elongated portion. The manipulation portion is positioned to be engaged by at least one finger of a user to counter a biasing force of the biasing portion. The manipulation member is positioned to be selectively engaged by at least one finger of a user to counter the bias of the biasing portion.

20 Claims, 21 Drawing Sheets

(56) References Cited

U.S. PATENT DOCUMENTS

| | | | | |
|---|---|---|---|---|
| 5,709,327 | A | 1/1998 | LaMacchia et al. | |
| 5,741,035 | A | 4/1998 | Glass | |
| 5,785,217 | A | 7/1998 | Gorham, Jr. | |
| 5,899,369 | A | 5/1999 | Macripo | |
| 5,934,526 | A | 8/1999 | Rosenbaum et al. | |
| 6,036,065 | A | 3/2000 | Wofford et al. | |
| 6,095,346 | A | 8/2000 | Idelberger | |
| D440,739 | S | 4/2001 | Hsu | |
| 6,293,444 | B1 | 9/2001 | Miller | |
| 6,484,910 | B1 | 11/2002 | Korkos | |
| 6,553,636 | B1 * | 4/2003 | Brenner | A44C 5/2038 24/334 |
| 6,620,177 | B2 * | 9/2003 | Buelna | A61B 17/11 606/153 |
| 6,854,625 | B2 | 2/2005 | Tedeschi | |
| 7,284,684 | B1 | 10/2007 | Gharavi | |
| 7,712,643 | B2 | 5/2010 | Papernik | |
| 7,721,924 | B2 | 5/2010 | McCluhan | |
| 7,784,383 | B2 | 8/2010 | Salva et al. | |
| 7,870,981 | B2 * | 1/2011 | Ionis | A47G 25/901 223/111 |
| 8,281,966 | B2 | 10/2012 | Rodgers | |
| 8,375,585 | B1 | 2/2013 | Sittler | |
| 8,752,814 | B1 | 6/2014 | Oliveto | |
| 2006/0219741 | A1 | 10/2006 | Clark | |
| 2007/0187440 | A1 | 8/2007 | Rosenbaum et al. | |
| 2011/0180573 | A1 | 7/2011 | Rodgers | |

* cited by examiner

BRACELET ATTACHING AID

CROSS-REFERENCE TO RELATED APPLICATIONS

This application claims priority to U.S. Provisional Application Ser. No. 62/325,522, same title herewith, filed on Apr. 21, 2016, which is incorporated in its entirety herein by reference.

BACKGROUND

The ability to attach some bracelets to a wrist of a user can be challenging. Some more involved bracelet connection designs can lead to the breaking of the bracelet in an attempt to attach the bracelet around the user's wrist.

For the reasons stated above and for other reasons stated below which will become apparent to those skilled in the art upon reading and understanding the present specification, there is a need in the art for an efficient and effective bracelet attaching aid.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

Embodiments of the present invention provide a bracelet attaching aid that assists in the attachment and removal of bracelets from a user's wrist. Embodiments of the bracelet attaching aid allow the user to dynamically regulate the amount of pressure needed to hold a connection portion of a bracelet during attachment and removal of a bracelet.

In one embodiment, a bracelet attaching aid is provided. The bracelet attaching aid includes a main base member, a biasing portion, and a manipulation portion. The main base member includes a first elongated portion terminating in a first holding end portion and a second elongated portion terminating in a second holding end portion. The first holding end portion and the second holding end portion are configured and arranged to selectively hold a connection portion of a bracelet there between. The biasing portion is coupled to bias the second holding end portion of the second elongated portion away from the first holding end portion of the first elongated member. The manipulation portion is coupled to the second elongated portion. The manipulation portion is positioned to be engaged by at least one finger of a user to counter a biasing force of the biasing portion. The manipulation member is positioned to be selectively engaged by at least one finger of a user to counter the bias of the biasing portion.

In an embodiment, the bracelet attaching aid includes a wrist stabilizing member that is coupled to the first elongated member proximate the first holding end portion. The wrist stabilizing member is shaped to engage a wrist of a user of the bracelet attaching aid.

In an embodiment, the wrist stabilizing member of the bracelet attaching aid has a semi-circular shape.

In an embodiment, the wrist stabilizing member of the bracelet attaching aid is pivotally coupled to the first elongated member.

In an embodiment, the manipulation member of the bracelet attaching aid is pivotally coupled to the second elongated member.

In an embodiment the manipulation member of the bracelet attaching aid is slidably coupled to the second elongated member.

In an embodiment, the bracelet attaching aid further includes a connecting member that couples the manipulation member to the second elongated member. The connecting member allows the manipulation member to rotate in relation to the second elongated member.

In an embodiment, the connecting member of the bracelet attaching aid further allows the manipulation member to slide along a length of the second elongated member.

In an embodiment, the manipulation member of the bracelet attaching aid includes a central bump out portion that is configured to engage the second elongated member.

In an embodiment, the biasing portion of the bracelet attaching aid includes at least one coil loop.

In an embodiment, the at least one coil loop of the biasing portion of the bracelet attaching aid is positioned proximate the second elongated member.

In an embodiment, the bracelet attaching aid further includes a guide bracket having a guide slot. The first and second elongated members are received within the guide slot proximate the first holding end portion and the second holding end portion of the respective first and second elongated members.

In an embodiment, the second elongated member of the bracelet attaching aid is coupled to the guide bracket.

In an embodiment, the bracelet attaching aid further includes a wrist stabilizing member that is pivotally coupled to the guide bracket. The guide bracket further includes a holding tab. A portion of the wrist stabilizing member is configured to be held within the holding tab when the bracelet attaching aid is in a use configuration.

In an embodiment, the bracelet attaching aid further includes a first protective sleeve and a second protective sleeve. The first protective sleeve is received around the first holding end portion of the respective first elongated member. The second protective sleeve is received around the second holding end portion of the second elongated member.

In an embodiment, another bracelet attaching aid is provided. The bracelet attaching aid includes a main base member, a biasing portion, a manipulation member and a wrist stabilizing member. The main base member includes a first elongated portion and a second elongated portion. The first elongated portion terminates in a first holding end portion. The second elongated portion terminates in a second holding end portion. The first holding end portion and the second holding end portion are configured and arranged to selectively hold a connection portion of a bracelet there between. The biasing portion is coupled to apply a biasing force to bias the second holding end portion of the second elongated portion away from the first holding end portion of the first elongated member. The manipulation member is coupled to the second elongated portion. The manipulation member is positioned to be selectively engaged by at least one finger of a user to counter the biasing force of the biasing portion. The wrist stabilizing member is coupled to the first elongated member proximate the first holding end portion. The wrist stabilizing member is shaped to engage a wrist of a user of the bracelet attaching aid.

In an embodiment, the manipulation member is pivotally coupled to the second elongated member of the bracelet attaching aid and the wrist stabilizing member pivotally coupled to the first elongated member of the bracelet attaching aid.

In an embodiment, the manipulation member of the bracelet attaching aid is slidably coupled to the second elongated member.

In another embodiment, yet another bracelet attaching aid is provided. This bracelet attaching aid includes a main base member, a manipulation member and a wrist stabilization member. The main base member has a first end holding portion, a second end holding portion and a biasing portion. The biasing portion biases the second end portion and the first end portion away from each other. The manipulation member is coupled to the main base member. The manipulation member is positioned to allow a user to counter the biasing of the biasing portion with at least one finger of the user to provide a desired holding force between the first holding portion and the second holding portion. The wrist stabilizing member is coupled to the main base member. The wrist stabilizing member is shaped to engage a wrist of the user of the bracelet attaching aid.

In an embodiment, the bracelet attaching aid has a storage configuration. The manipulation member and the wrist stabilization member are configured to rotate in relation to the main base member in the storage configuration.

In an embodiment the manipulation member of the bracelet attaching aid is slidably coupled to the main base member to allow for the positioning of the manipulation member in relation to the base member based on a hand and wrist anatomy of the user.

BRIEF DESCRIPTION OF THE DRAWINGS

The present invention can be more easily understood and further advantages and uses thereof will be more readily apparent, when considered in view of the detailed description and the following figures in which.

In accordance with common practice, the various described features are not drawn to scale but are drawn to emphasize specific features relevant to the present invention. Reference characters denote like elements throughout Figures and text.

DETAILED DESCRIPTION

Figure 1:
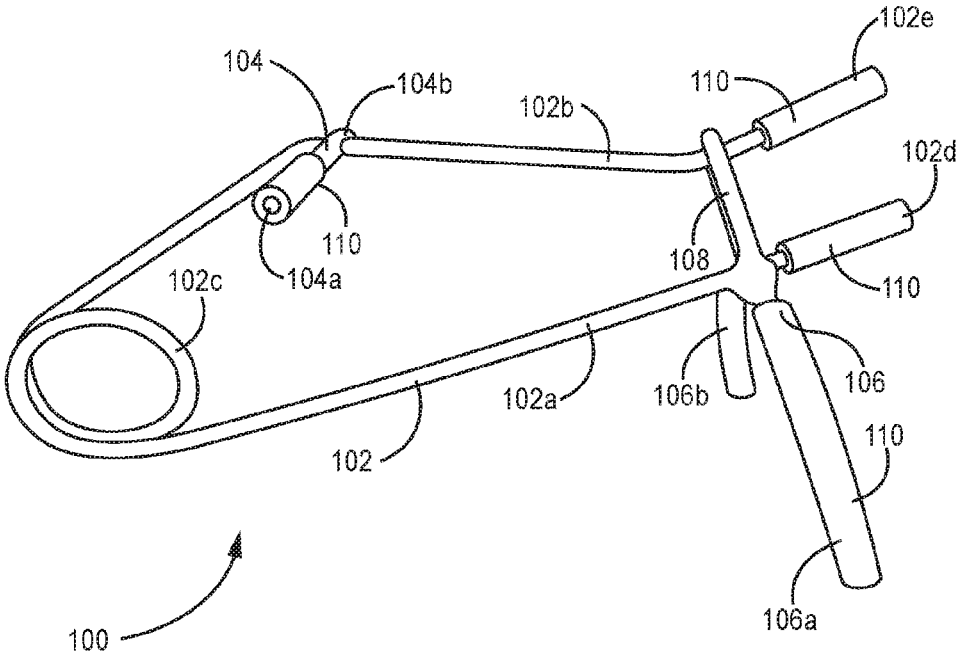
FIG. 1 is a first perspective side view of a first embodiment of a bracelet attaching aid of one embodiment of the present invention.
Figure 2:
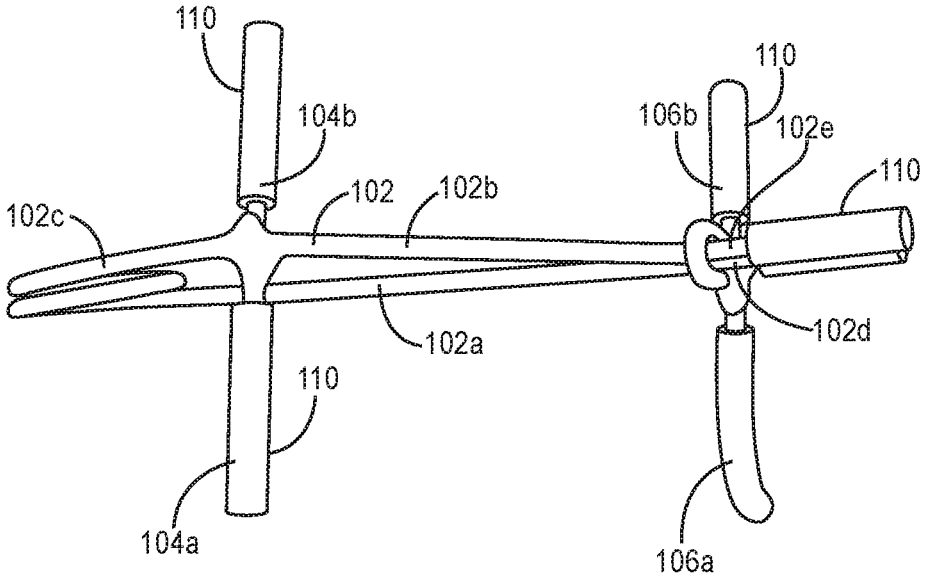
FIG. 2 is a top view of the bracelet attaching aid of FIG. 1.
Figure 3:
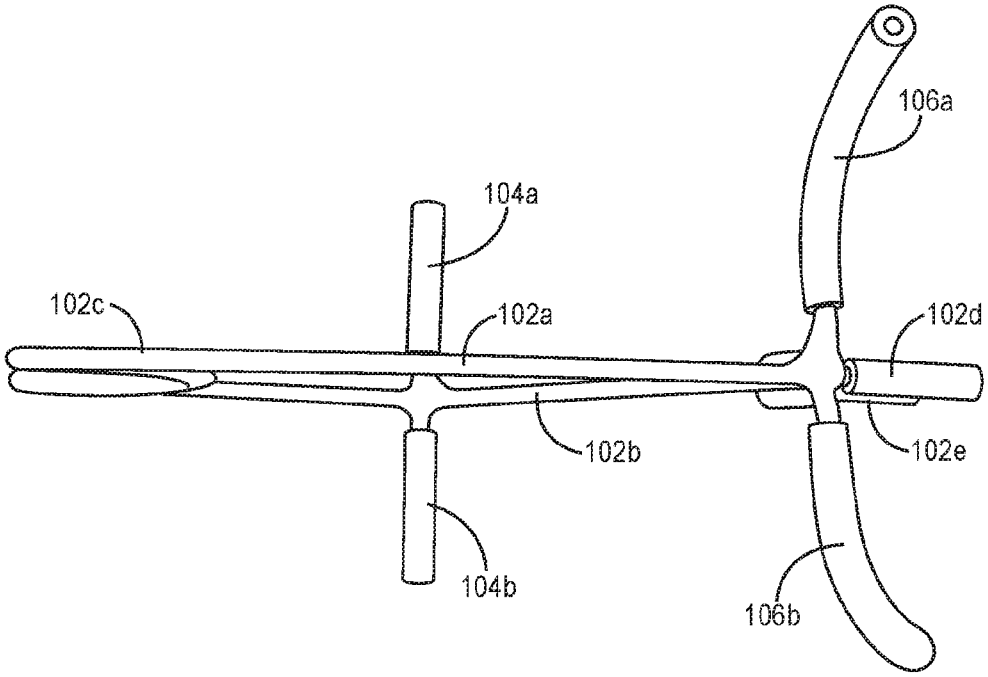
FIG. 3 is a bottom view of the bracelet attaching aid of FIG. 1.
Figure 4:
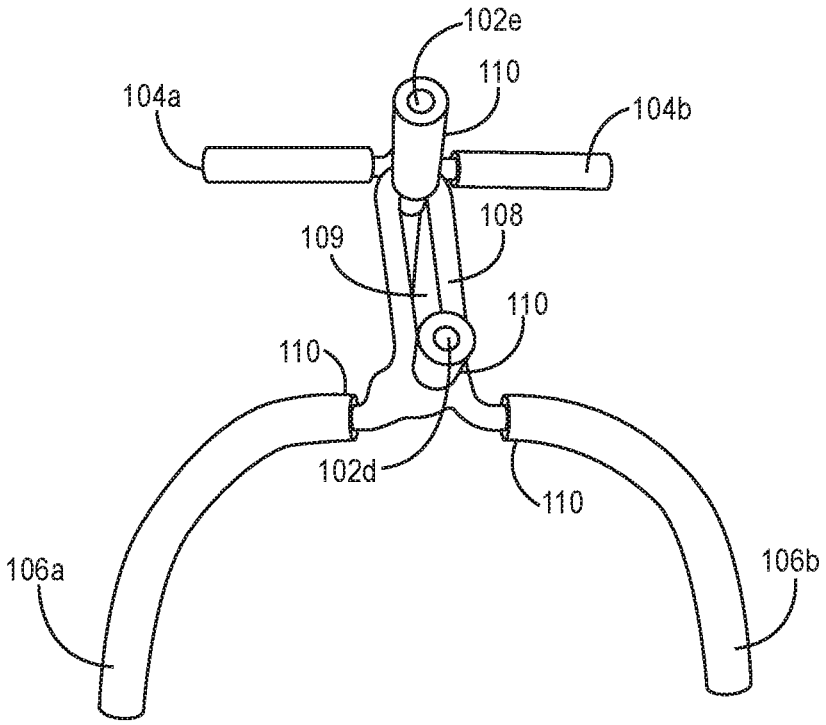
FIG. 4 is a front view of the bracelet attaching aid of FIG. 1.
Figure 5:
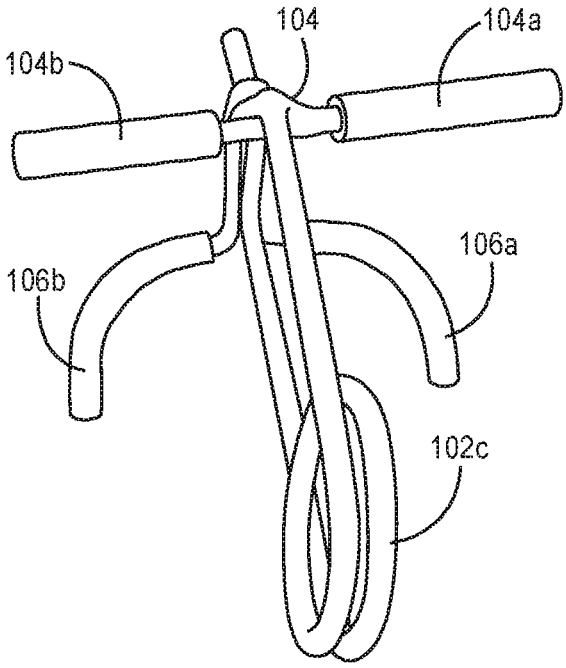
FIG. 5 is a rear view of the bracelet attaching aid of FIG. 1.
Figure 6:
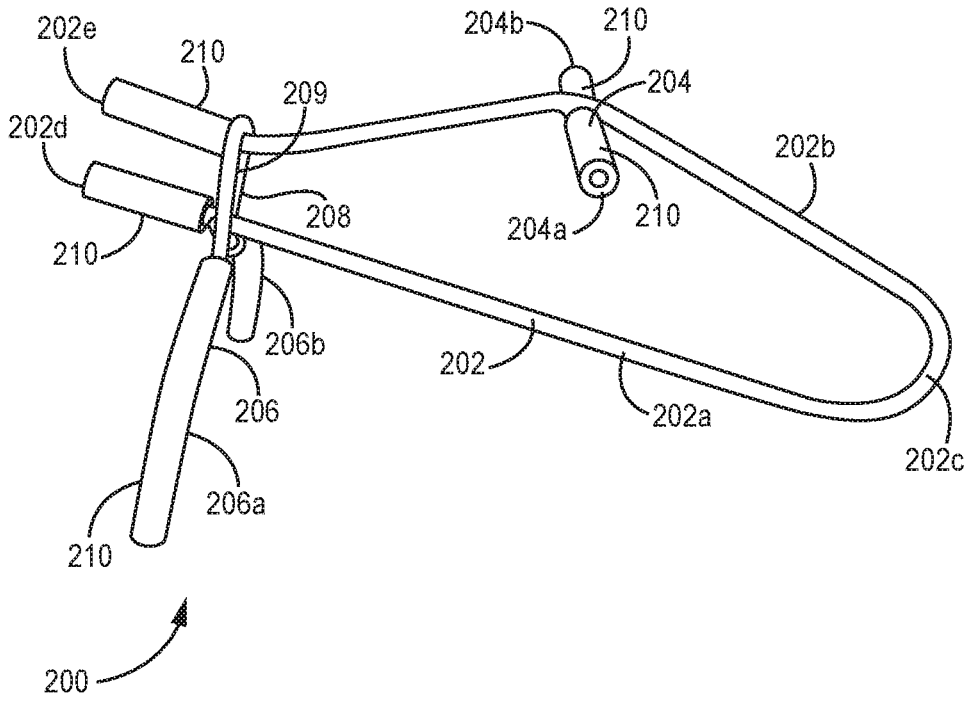
FIG. 6 is a first side perspective view of another embodiment of the bracelet attaching aid of an embodiment of the present invention.
Figure 7:
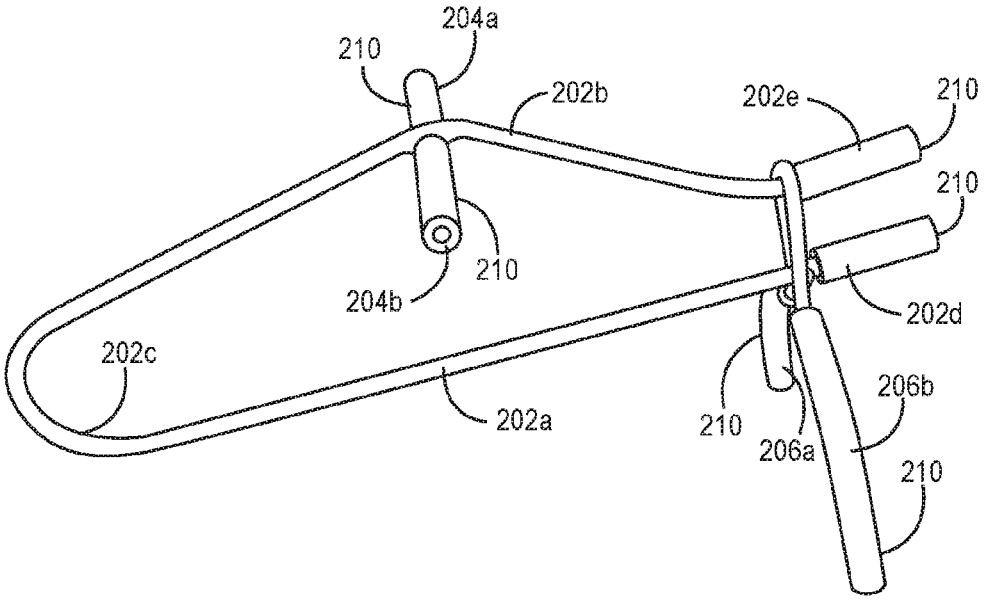
FIG. 7 is a second side perspective view of the bracelet attaching aid of FIG. 6.
Figure 8:
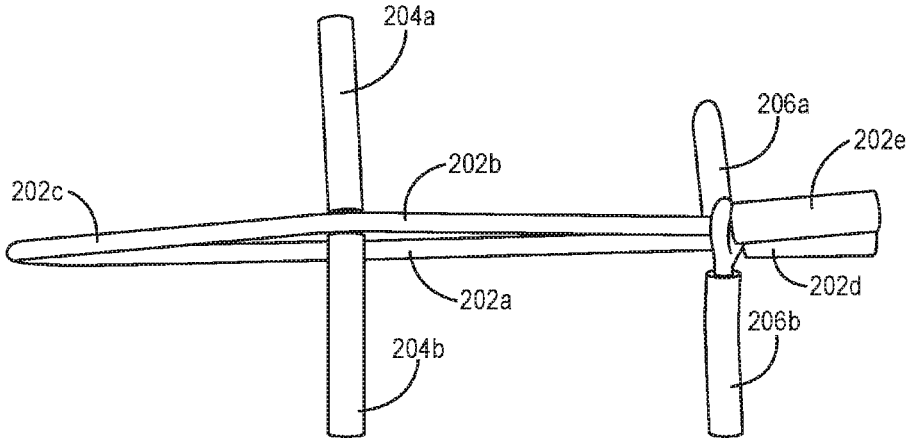
FIG. 8 is a top view of the bracelet attaching aid of FIG. 6.
Figure 9:
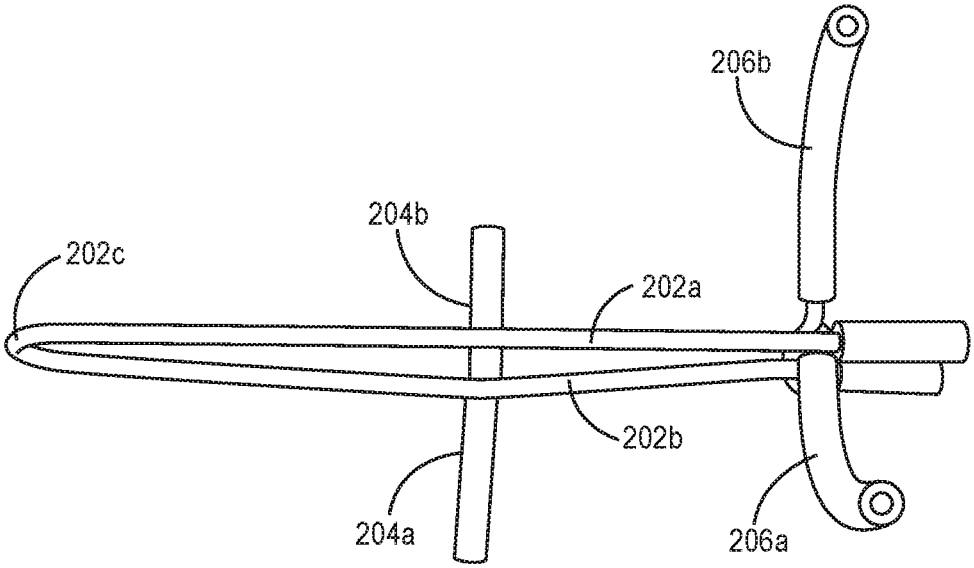
FIG. 9 is a bottom view of the bracelet attaching aid of FIG. 6.
Figure 10:
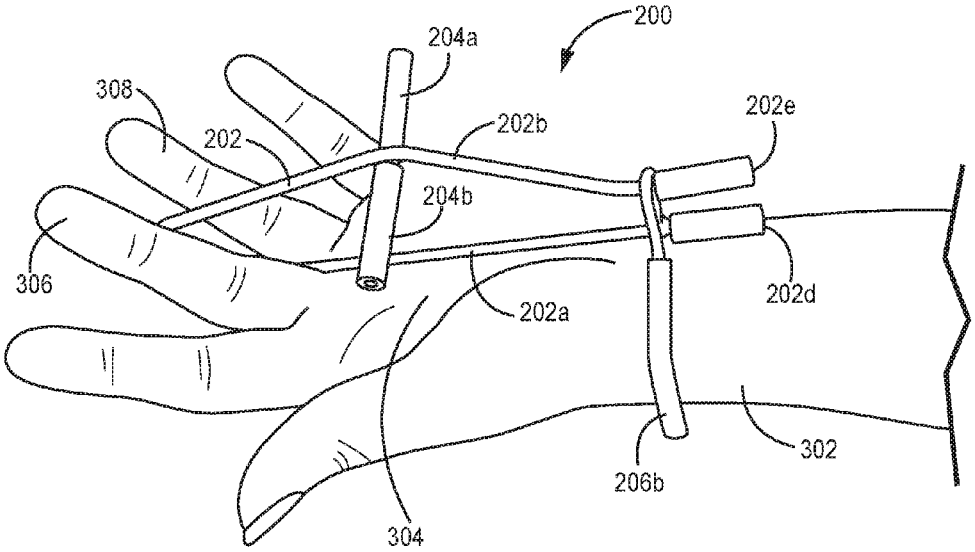
FIG. 10 is a second side perspective view of the bracelet attaching aid of FIG. 6 being positioned in relation to a user's hand.

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Embodiments of the present invention provide a bracelet attaching aid that aids in attaching bracelets to a user's wrist. The design of embodiments allows a user's hand to control the force in which a connection portion of the bracelet is held. In particular, the hand controlling the force is part of the arm in which the bracelet is to be attached.

Referring to FIGS. 1-5, a bracelet attaching aid 100 of one embodiment is illustrated. The bracelet attaching aid 100 include a main base member 102. The main base member 102 includes a first elongated portion 102*a* and a second elongated portion 102*b*. In this embodiment, at the connecting ends of the first elongated portion 102*a* and the second elongated portion 102*b* are coupled together by a biasing portion 102*c*. The biasing portion 102*c* in this embodiment includes at least one coil loop as illustrated. The first elongated portion 102*a* terminates in a first holding end portion 102*d* and the second elongated portion terminates in a second holding end portion 102*e*. The first holding end portion 102*d* and the second holding end portion 102*e* are received within a guide slot 109 in a guide portion 108 (guide bracket 109). The biasing portion 102*c* is designed to bias the second holding end portion 102*e* away from the first holding end portion 102*d*. In one embodiment, the first holding end portion 102*d* is coupled proximate a first end of the slot 109 of the guide portion 108.

The bracelet attaching aid 100 further includes a wrist stabilizing member 106 that includes a first wrist stabilizing arm 106*a* and a second wrist stabilizing arm 106*b*. The wrist stabilizing member 106 in this embodiment is coupled proximate the first end of the slot 109 of the guide portion 108. The bracelet attaching aid 100 further includes a manipulation member 104 that includes, in this embodiment, a first manipulation post 104*a* and a second manipulation post 104*b*. The manipulation member 104 is coupled to the second elongated portion 102*b* of the main base member 102 proximate a mid-portion of the second elongated portion 102*b*. This embodiment further includes protective sleeves 110 that are positioned around at least portions of the first manipulation post 104*a*, the second manipulation post 104*b*, the first holding end portion 102*d*, the second holding end portion 102*e*, the first wrist stabilizing portion 106*a* and the second wrist stabilizing portion 106*b*. The protective sleeves 110 are made of a rubber or polymer type material designed to protect the user and the bracelet from hard or sharp surface contact. The protective sleeve 110 may also provide a surface that increase friction to enhance the operations of the bracelet attaching aid.

Referring to FIGS. 6-9, a bracelet attaching aid 200 of another embodiment is illustrated. The bracelet attaching aid 200 includes a main base member 202. The main base member 202 includes a first elongated portion 202*a* and a second elongated portion 202*b*. In this embodiment, at the connecting ends of the first elongated portion 202*a* and the second elongated portion 202*b* are coupled together by a biasing portion 202*c*. The biasing portion 202*c* in this embodiment does not include at least one loop. The first elongated portion 202*a* terminates in a first holding end portion 202*d* and the second elongated portion terminates in a second holding end portion 202*e*. The first holding end portion 202*d* and the second holding end portion 202*e* are received within a slot 209 in a guide portion 208. The biasing portion 202*c* is designed to bias the second holding end portion 202*e* away from the first holding end portion 202*d*. In one embodiment, the first holding end portion 202*d* is coupled proximate a first end of the slot 209 of the guide portion 208.

The bracelet attaching aid 200 further includes a wrist stabilizing member 206 that includes a first wrist stabilizing arm 206*a* and a second wrist stabilizing arm 206*b*. The wrist stabilizing member 206 in this embodiment is coupled proximate the first end of the slot 209 of the guide portion 208. The bracelet attaching aid 200 further includes a manipulation member 204 that includes, in this embodiment, a first manipulation post 204*a* and a second manipulation post 204*b*. The manipulation member 204 is coupled to the second elongated portion 202*b* of the main base member 202 proximate a mid-portion of the second elongated portion 202*b*. This embodiment further includes protective sleeves 210 that are positioned around at least portions of the first manipulation post 204*a*, the second manipulation post 204*b*, the first holding end portion 202*d*, the second holding end portion 202*e*, the first wrist stabilizing portion 206*a* and the second wrist stabilizing portion 206*b*. The protective sleeves 210 are made of a rubber or polymer type material to protect the user and the bracelet during use of the bracelet attaching aid. In other embodiments, the first holding end portion 202*d* and the second holding end portion 202*e* are bent or are tilted to get closer to a user's wrist during use.

Figure 11:
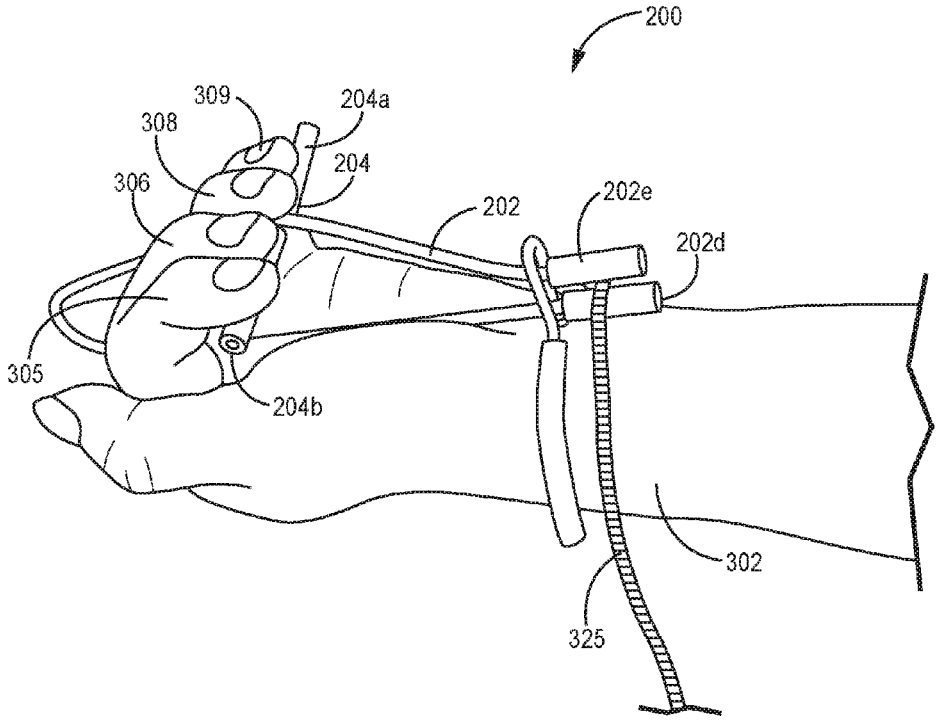
FIG. 11 is a second side perspective view of the bracelet attaching aid of FIG. 6 illustrating the user activating the bracelet attaching aid to grasp a first connection portion of a bracelet.

FIGS. 10-13 illustrate the use of the bracelet attaching aid 200. In particular, in FIG. 10, the positioning of the bracelet attaching aid 200 in a user's hand is illustrated. As illustrated, the first elongated portion 202*a* of the main base member 202 is positioned in the hand of the user while a portion of the main base member 202 extends through the middle fingers 306 and 308 of the user. The first stabilizing arm 206*a* and the second stabilizing arm 206*b* of the wrist stabilizing member 206 are further positioned to engage the wrist 302 of the user. FIG. 11 illustrates a first connection portion of the bracelet 325 being held by the bracelet attaching aid 200. To accomplish this, the user with his or her other hand positions the first connection portion of the bracelet 325 between the first holding end portion 202*d* and the second holding end portion 202*e*. The user then engages the manipulation member 204 with at least one finger 306 or 308 and tightens his or her grip to counter the biasing force of the biasing portion 202*c*. The tighter the grip the more force is applied to retain the first connection portion of the bracelet 325 between the first holding end portion 202*d* and the second holding end portion 202*e*.

Figure 12:
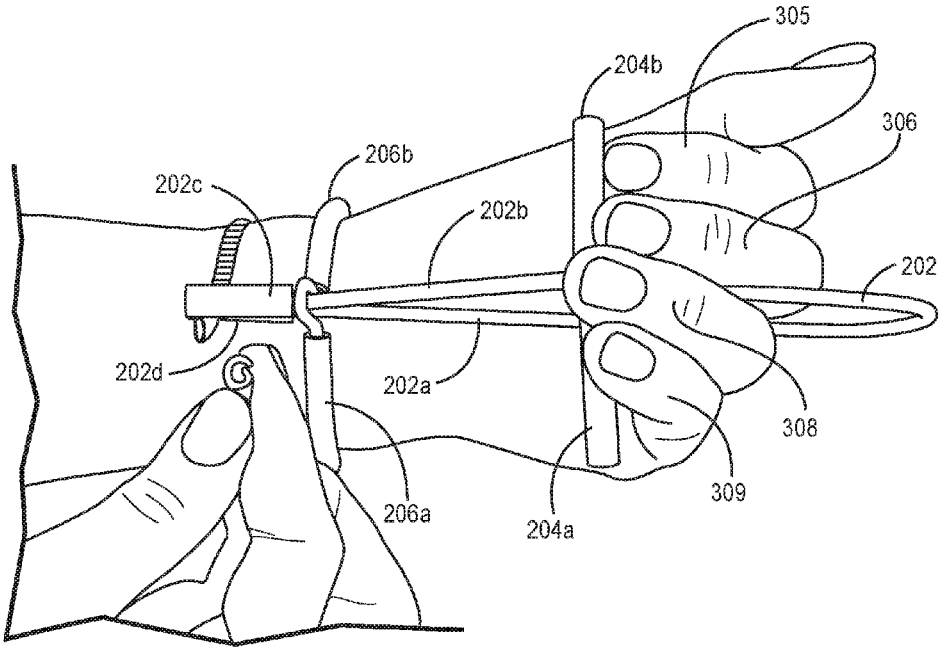
FIG. 12 is a top perspective view of the bracelet attaching aid of FIG. 6 illustrating the user holding the first connection portion of the bracelet with the bracelet attaching aid while positioning a second connection portion of the bracelet.
Figure 13:
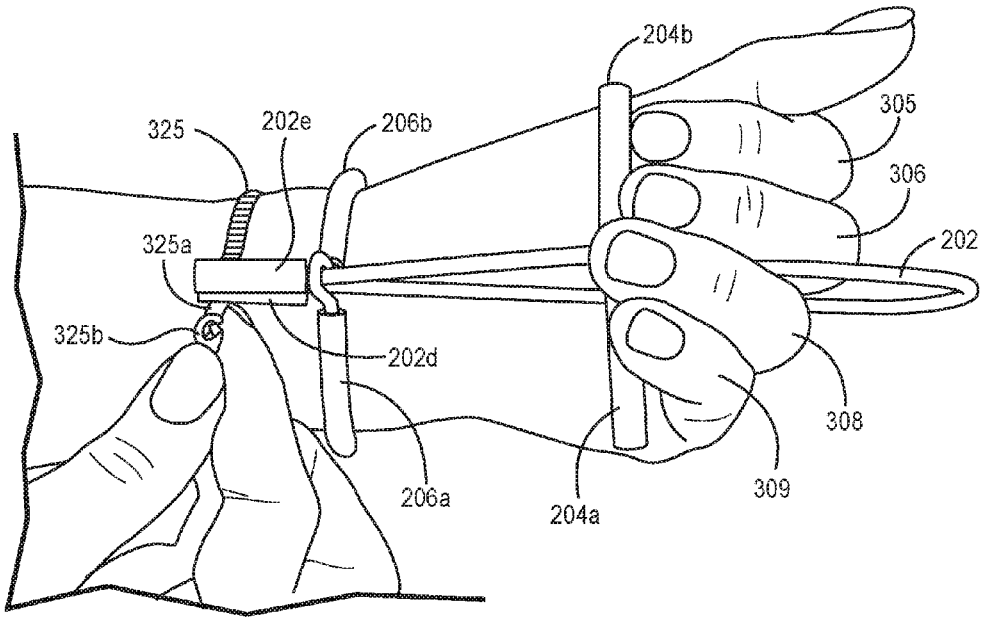
FIG. 13 is a top perspective view of the bracelet attaching aid of FIG. 6 illustrating the user holding the first connection portion of the bracelet with the bracelet attaching aid while attaching the second connection portion of the bracelet to the first connection portion.

Once the first connection portion 325*a* of the bracelet 325 is firmly held between the first holding end portion 202*d* and the second holding end portion 202*e*, a second connection portion 325*b* of the bracelet 325 is positioned for attaching to the first connection portion 325*a* by the user's other hand as illustrated in FIG. 12. The first second connection portion 325*b* of the bracelet 325 is then connected to the first connection portion 325*a* of the bracelet 325 as illustrated in FIG. 13. As described, the force applied to hold the first connection portion 325*a* of the bracelet can be adjusted as needed in embodiments by simply adjusting the force on the manipulation portion 204 of the bracelet attaching aid 200.

Figure 14:
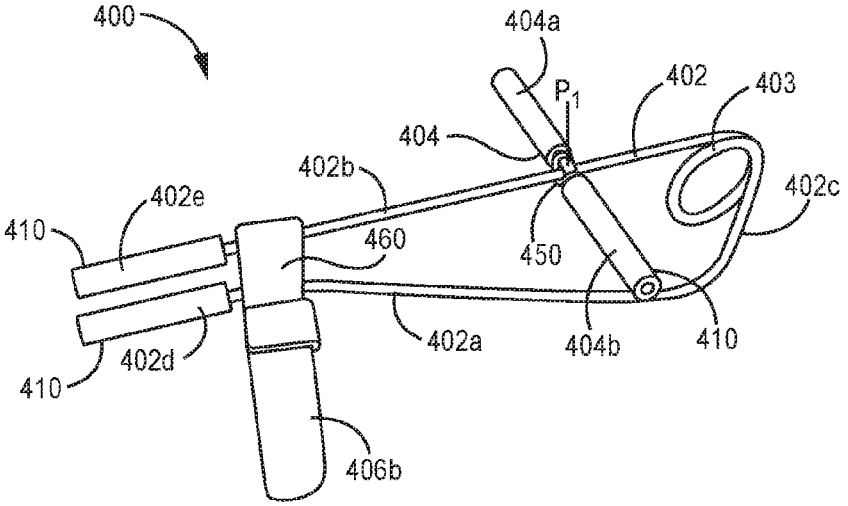
FIG. 14 is a side perspective view of a bracelet attaching aid of another embodiment of the present invention.

FIG. 14 illustrates yet another embodiment of a bracelet attaching aid 400. This embodiment is designed to have a use configuration and a storage configuration. The storage configuration allows the bracelet attaching aid 400 to be stored or transported without taking up much space. This embodiment, further allows for the adjustment of the position of the manipulation member so the bracelet attaching aid can be adjusted to fit different sized hands when in use.

The bracelet attaching aid 400 includes a main base member 402. The main base member 402 includes a first elongated portion 402*a* and a second elongated portion 402*b*. In this embodiment, at the connecting ends of the first elongated portion 402*a* and the second elongated portion 402*b* are coupled together by a biasing portion 402*c*. The biasing portion 402*c* in this embodiment includes at least one coil loop 403 as illustrated. Further in this embodiment, the coil loop 403 of the biasing portion 402*c* is positioned proximate the second elongated member 402*b*. The first elongated portion 402*a* terminates in a first holding end portion 402*d* and the second elongated portion terminates in a second holding end portion 402*e*. The first holding end portion 402*d* and the second holding end portion 402*e* are received within a guide slot 462 (best seen in FIG. 21) in a guide bracket 460. The biasing portion 402*c* is designed to bias the second holding end portion 402*e* away from the first holding end portion 402*d*. In one embodiment, the first holding end portion 402*d* is coupled proximate a first end of the guide slot 462 of a guide portion 460 (guide bracket 460).

The bracelet attaching aid 400 further includes a wrist stabilizing member 406 that includes a first wrist stabilizing arm 406*a* and a second wrist stabilizing arm 406*b*. The wrist stabilizing member 406 in this embodiment is coupled proximate the first end of the slot 462 of the guide bracket 460. Bracelet attaching aid 400 further includes a manipulation member 404 that includes, in this embodiment, a first manipulation post 404*a* and a second manipulation post 404*b*. The manipulation member 404 is coupled to the second elongated portion 402*b* of the main base member 402. This embodiment further includes protective sleeves 410 that are positioned around at least portions of the first manipulation post 404*a*, the second manipulation post 404*b*, the first holding end portion 402*d* and the second holding end portion 402*e*. The protective sleeves 410 are made of a rubber or polymer type material designed to protect the user and the bracelet from hard or sharp surface contact.

Figure 15:
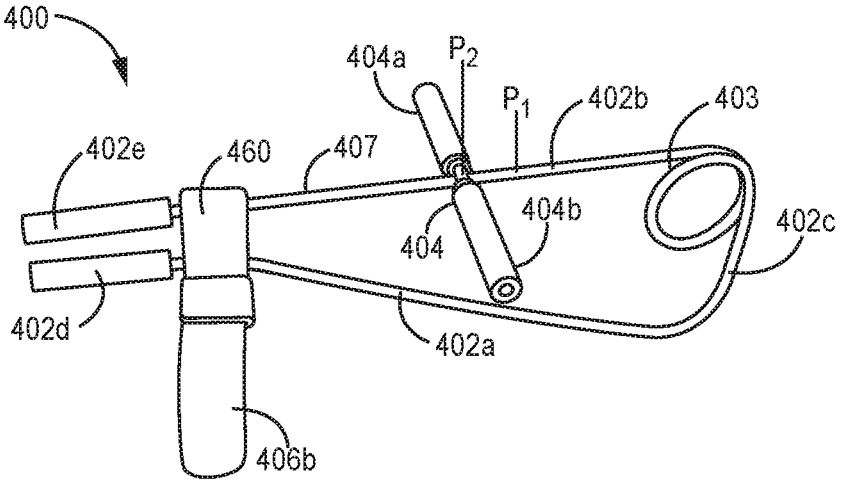
FIG. 15 is a side perspective view of the bracelet attaching aid of FIG. 14 with the manipulation post being moved to second different location along an elongated member.

The manipulation member 404 in this embodiment is designed to be selectively moved to different locations along the second elongated member 402*b* to adjust to fit the user's hand during use. For example, in FIG. 14 the manipulation member 404 is shown positioned at $P_1$ on the second elongated member 402*b*. In FIG. 15, the manipulation member 404 has been repositioned to $P_2$. The $P_2$ location of the manipulation member 404 may provide a better fit for a user having longer fingers than the fit when the manipulation member 404 is at the $P_1$ location. The repositioning also provides a system that can be manipulated to achieve a desired leverage in moving the second elongated member 402*b* in relation to the first elongated member 402*a* to manipulate the distance between the respective first holding end portion 402*d* and the second holding end portion 420*e*.

Figure 16:
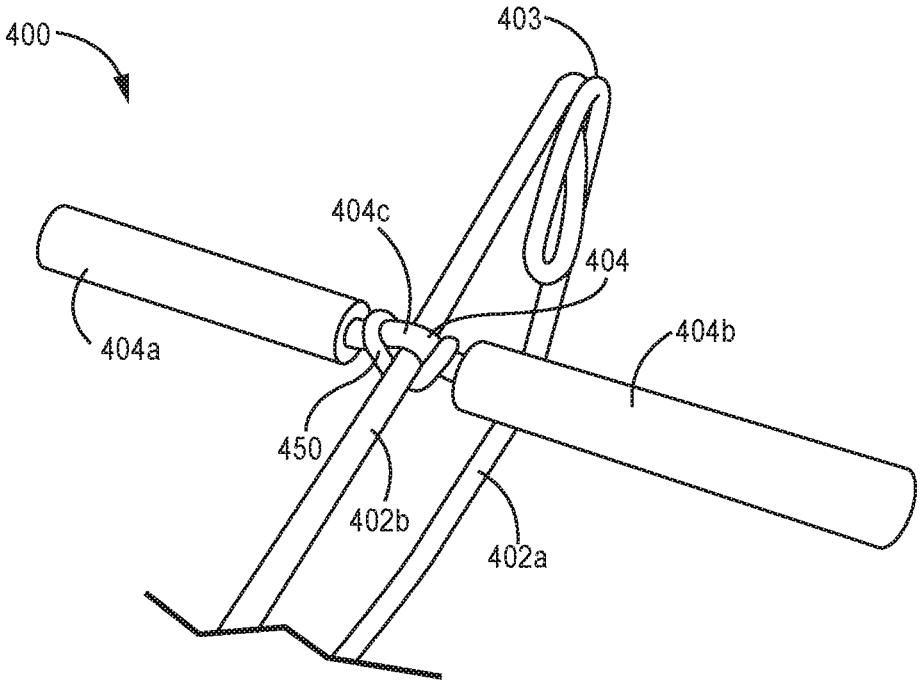
FIG. 16 is a close up view of a connecting member of the bracelet attaching aid of FIG. 14.
Figure 17:
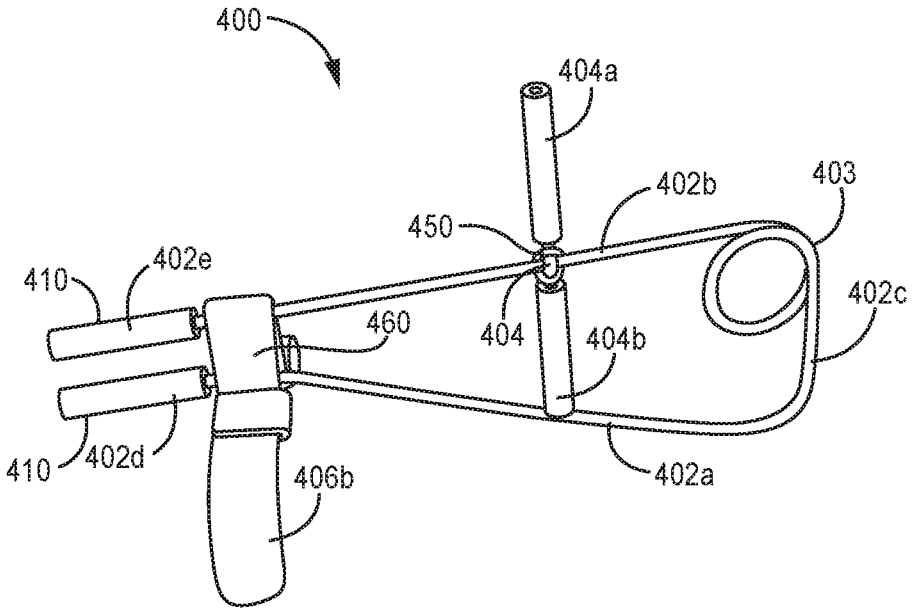
FIG. 17 is a first side view of the bracelet attaching aid of FIG. 14 with the manipulation member in a storage configuration.

FIG. 16 illustrates a close up view of a connecting member 450 that in one embodiment, couples the manipulation member 404 to the second elongated member 402*b*. In one embodiment, the elongated member is made from an elastic material, such as but not limited to, rubber. In one embodiment, the connecting member 450 is a rubber O-ring. Further, as illustrated in FIG. 16, in one embodiment, the manipulation member 404 includes a central bump out portion 404*c* that is designed to engage the second elongated member 402*b*. The shape of the central bump out portion 404*c* helps retain proper central alignment of the manipulation member 404 with respect to the second elongated member 402*b* of the main base member 402 and retains the connecting member 450 in a desired location in relation to the manipulation member 404 and the second elongated member 402*b*. Another feature of this configuration is that the manipulation member 404 can be pivoted in relation to the second elongated member 402*b* as illustrated in FIG. 17. In particular, FIG. 17 illustrates the manipulation member 404 pivoted in relation to the main base member 402.

Figure 18:
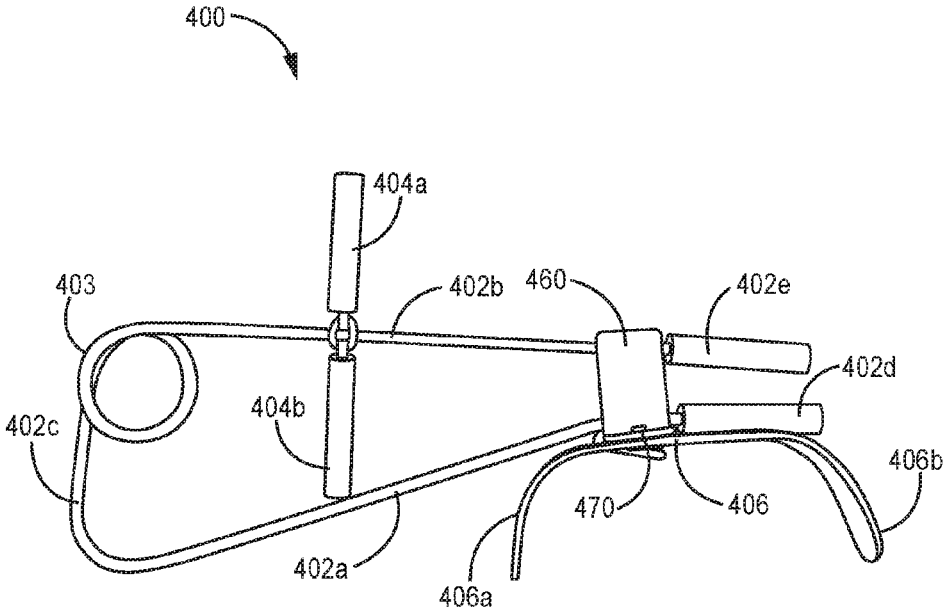
FIG. 18 is a second side view of the bracelet attaching aid of FIG. 14 with both the manipulation member and the wrist stabilizing member being in a storage configuration.

The wrist stabilizing member 406 of the bracelet attaching aid 400 is also designed to pivot in an embodiment. Referring to FIG. 18, the wrist stabilizing member 406 has been pivoted about pivot 470 in relation to the main base member 402. In FIG. 18 the bracelet attaching aid 400 in the stored configuration is illustrated. In the stored configuration the manipulation member 404 and the wrist stabilizing member 406 are pivoted in relation to the main base member body 402 to be positioned proximate top a plane of the main base body 402 to reduce the overall width size of the bracelet attaching aid 400. Hence, the bracelet attaching aid can take up less space when stored or transported.

Figure 19:
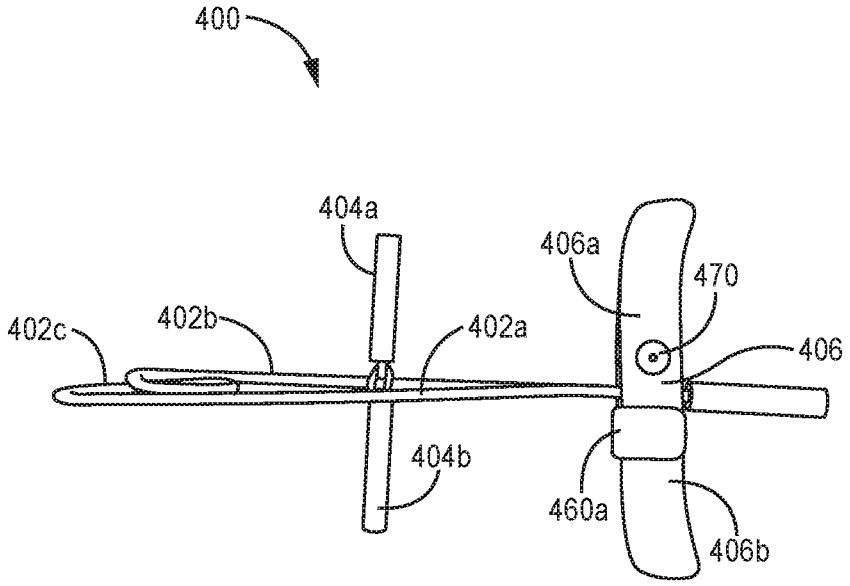
FIG. 19 is a bottom view of the bracelet attaching aid of FIG. 14.
Figure 20:
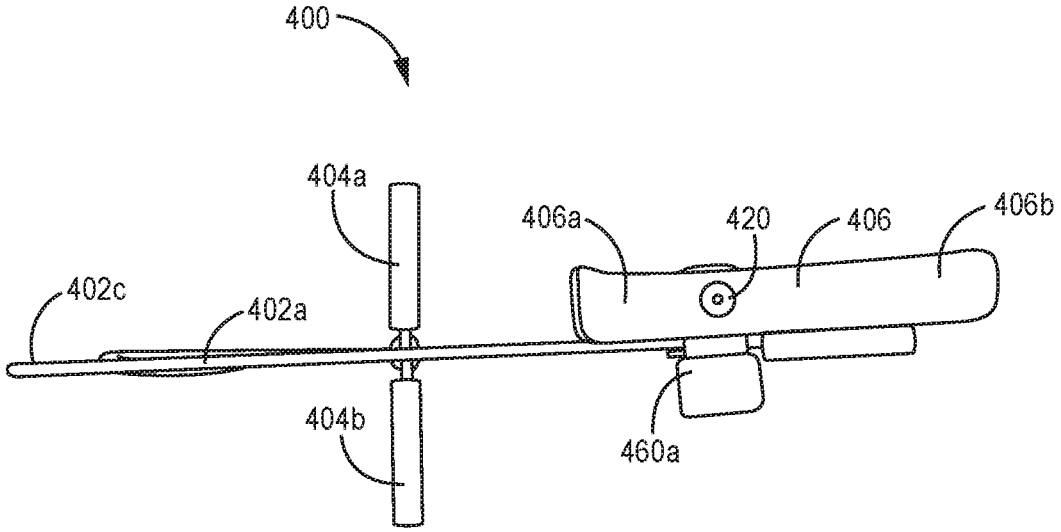
FIG. 20 is a bottom view of the bracelet attaching aid of FIG. 14 with the wrist stabilizing member pivoted into the storage configuration.
Figure 21:
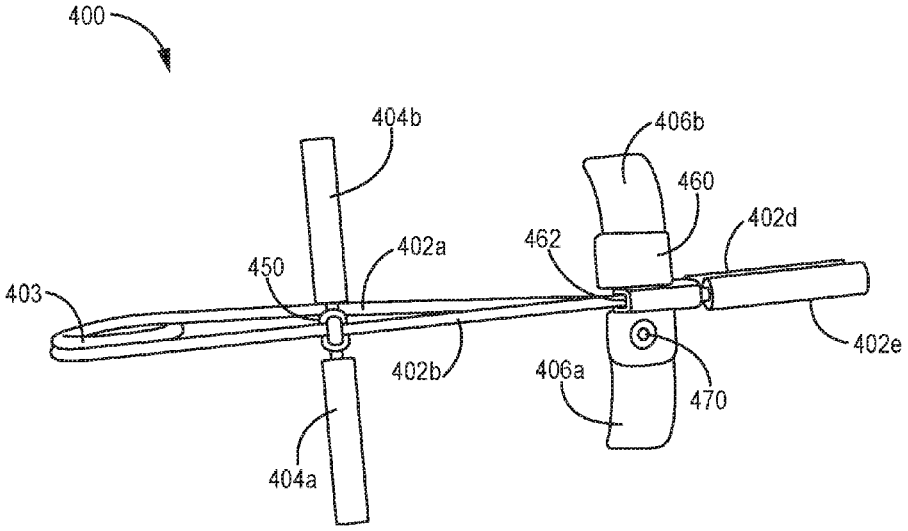
FIG. 21 is a top view of the bracelet attaching aid of FIG. 14.

FIG. 19 illustrates a bottom view of the bracelet attaching aid 400 in the use configuration. This view illustrates the guide bracket 460 includes a holding tab 460*a* that receives a portion of the wrist stabilizing member 406 when the bracket attaching aid 400 is in the use configuration. The guide bracket 460 ensures the proper position of the wrist stabilizing member 406 when the bracelet attaching aid 400 is in the use configuration. FIG. 21 illustrates the bottom view of bracelet attaching aid 400 with the wrist stabilizing member 406 pivoted in the stored configuration. As illustrated, in this configuration, the portion of the wrist stabilizing member 406 is pivoted away from the holding tab 460*a* of the guide bracket 460. FIG. 21 further illustrates a top view of bracelet attaching aid 400 in the use configuration.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A bracelet attaching aid comprising:

a main base member including, a first elongated portion terminating in a first holding end portion, and a second elongated portion terminating in a second holding end portion, the first holding end portion and the second holding end portion configured and arranged to selectively hold a portion of a bracelet there between;

a biasing portion coupled to bias the second holding end portion of the second elongated portion away from the first holding end portion of the first elongated member;

a manipulation member coupled to the second elongated portion, the manipulation member positioned to be selectively engaged by at least one finger of a user to counter the bias of the biasing portion; and wherein the manipulation member is pivotally coupled to the second elongated member.

2. The bracelet attaching aid of claim 1, further comprising:

a wrist stabilizing member coupled to the first elongated member proximate the first holding end portion, the wrist stabilizing member shaped to engage a wrist of a user of the bracelet attaching aid.

3. The bracelet attaching aid of claim 2, wherein the wrist stabilizing member has a semi-circular shape.

4. The bracelet attaching aid of claim 2, wherein the wrist stabilizing member is pivotally coupled to the first elongated member.

5. The bracelet attaching aid of claim 1, further comprising:

a protective sleeve received around at least a portion of the manipulation member.

6. The bracelet attaching aid of claim 1, wherein the manipulation member is slidably coupled to the second elongated member.

7. The bracelet attaching aid of claim 1, further comprising:

a connecting member coupling the manipulation member to the second elongated member, the connecting member allowing the manipulation member to rotate in relation to the second elongated member.

8. The bracelet attaching aid of claim 7, wherein the connecting member further allows the manipulation member to slide along a length of the second elongated member.

9. The bracelet attaching aid of claim 7, wherein the manipulation member includes a central bump out portion configured to engage the second elongated member.

10. The bracelet attaching aid of claim 1, wherein the biasing portion includes at least one coil loop.

11. The bracelet attaching aid of claim 10, wherein the at least one coil loop of the biasing portion is positioned proximate the second elongated member.

12. The bracelet attaching aid of claim 1, further comprising:

a guide bracket having a slot, the first and second elongated members received within the slot proximate the first holding end portion and the second holding end portion of the respective first and second elongated members.

13. The bracelet attaching aid of claim 12, wherein the second elongated member is coupled to the guide bracket.

14. The bracelet attaching aid of claim 12, further comprising:

a wrist stabilizing member pivotally coupled to the guide bracket; and the guide bracket including a holding tab, a portion of the wrist stabilizing member configured to be held within the holding tab when the bracelet attaching aid is in a use configuration.

15. The bracelet attaching aid of claim 1, further comprising:

a first protective sleeve received around the first holding end portion of the respective first elongated member; and a second protective sleeve received around the second holding end portion of the second elongated member.

16. A bracelet attaching aid comprising:

a main base member including, a first elongated portion terminating in a first holding end portion, and a second elongated portion terminating in a second holding end portion, the first holding end portion and the second holding end portion configured and arranged to selectively hold a connection portion of a bracelet there between;

a biasing portion coupled to apply a biasing force to bias the second holding end portion of the second elongated portion away from the first holding end portion of the first elongated member;

a manipulation member coupled to the second elongated portion, the manipulation member positioned to be selectively engaged by at least one finger of a user to counter the biasing force of the biasing portion; and a wrist stabilizing member coupled to the first elongated member proximate the first holding end portion, the wrist stabilizing member shaped to engage a wrist of a user of the bracelet attaching aid.

17. The bracelet attaching aid of claim 16, further comprising:

the manipulation member pivotally coupled to the second elongated member; and the wrist stabilizing member pivotally coupled to the first elongated member.

18. The bracelet attaching aid of claim 15, wherein the manipulation member is slidably coupled to the second elongated member.

19. A bracelet attaching aid comprising:

a main base member having a first end holding portion, a second end holding portion and a biasing portion, the biasing portion biasing the second end portion and the first end portion away from each other;

a manipulation member coupled to the main base member, the manipulation member positioned to allow a user to counter the biasing of the biasing portion with at least one finger of the user to provide a desired holding force between the first holding portion and the second holding portion; and a wrist stabilizing member coupled to the main base member, the wrist stabilizing member shaped to engage a wrist of the user of the bracelet attaching aid.

20. The bracelet attaching aid of claim 19, further comprising:

the bracelet attaching aid having a storage configuration, the manipulation member and the wrist stabilization member being configured to rotate in relation to the main base member in the storage configuration; and the manipulation member being slidably coupled to the main base member to allow for the positioning of the manipulation member in relation to the base member based on a hand and wrist anatomy of the user.

* * * * *